US006923036B1

(12) United States Patent
Stefanek

(10) Patent No.: US 6,923,036 B1
(45) Date of Patent: Aug. 2, 2005

(54) HEMMING APPARATUS AND METHOD

(76) Inventor: Ronald C. Stefanek, 9537 Silica Sand Rd., Garrettsville, OH (US) 44231

( * ) Notice: Subject to any disclaimer, the term of this patent is extended or adjusted under 35 U.S.C. 154(b) by 0 days.

(21) Appl. No.: 10/019,117

(22) PCT Filed: Jun. 29, 2000

(86) PCT No.: PCT/US00/17933

§ 371 (c)(1),
(2), (4) Date: May 17, 2002

(87) PCT Pub. No.: WO01/00918

PCT Pub. Date: Jan. 4, 2001

Related U.S. Application Data

(60) Provisional application No. 60/141,434, filed on Jun. 29, 1999.

(51) Int. Cl.[7] ..... B21D 39/02
(52) U.S. Cl. ..... 72/306; 29/243.58; 72/312
(58) Field of Search ..... 72/312, 315, 323, 72/306, 387; 29/243.5, 243.58, 243.57

(56) References Cited

U.S. PATENT DOCUMENTS

| | | | | |
|---|---|---|---|---|
| 1,693,643 A | | 12/1928 | D'Ardenne | |
| 1,961,582 A | | 6/1934 | Eksergian | |
| 3,143,095 A | | 8/1964 | Tribe | |
| 3,903,934 A | | 9/1975 | Vizy | |
| 4,346,579 A | * | 8/1982 | Takatsu | 72/314 |
| 4,453,396 A | | 6/1984 | Takatsu | |
| 5,315,855 A | | 5/1994 | Jackson | |

FOREIGN PATENT DOCUMENTS

| | | | | |
|---|---|---|---|---|
| JP | 56131018 A | * | 10/1981 | B21D 19/08 |
| JP | 57-124524 | | 3/1982 | |
| JP | 57124524 A | * | 8/1982 | B21D 19/14 |
| JP | 57-184520 | | 11/1982 | |
| JP | 57184520 A | * | 11/1982 | B21D 19/08 |
| JP | 1-249226 | | 4/1989 | |
| JP | 01249257 A | * | 10/1989 | B22D 19/08 |
| JP | 3-184635 | | 12/1991 | |

(Continued)

OTHER PUBLICATIONS

PCT Written Opinion dated Dec. 21, 2001.

*Primary Examiner*—Lowell A. Larson
(74) *Attorney, Agent, or Firm*—Fay, Sharpe, Fagan, Minnich & McKee, LLP

(57) ABSTRACT

In accordance with the present invention, an improved apparatus and method for prehemming and hemming is provided. More particularly, the improved apparatus and method is for folding an edge portion of a curved arcuate panel to create a hem in a single cycle of operation with a single hemming swing steel pressed only in the vertical direction. The apparatus and method use an anvil for supporting an associated assembly of the outer skin and the inner panel, an upper body, and a steel mounted to the upper body. The steel is moved between first and second operative positions and has a first angled surface for prehemming the assembly when the steel is in the first operative position and a second angled surface for fullhemming the assembly when the steel is in the second operative position.

24 Claims, 6 Drawing Sheets

FOREIGN PATENT DOCUMENTS

| | | | | | |
|---|---|---|---|---|---|
| JP | 06190458 | A | * | 7/1994 | ..... B21D 19/08 |
| JP | 7-88567 | | | 4/1995 | |
| JP | 11078719 | A | * | 3/1999 | ..... B60R 13/02 |
| JP | 2000-288660 | | | 10/2000 | |
| JP | 2000-343156 | | | 12/2000 | |

* cited by examiner

HEMMING APPARATUS AND METHOD

This application claims the benefit of and hereby expressly incorporates by reference U.S. Provisional Application Ser. No. 60/141,434, filed on Jun. 29, 1999.

BACKGROUND OF THE INVENTION

1. Field of the Invention

The present invention relates to the hemming arts. More particularly, the present invention relates to improvements in a hemming apparatus and an improved method for hemming sheet metal or like material together. The present invention finds particular application in the automotive field and will be described with particular reference thereto. However, it is to be appreciated that the present invention is also amenable to other like applications.

2. Discussion of the Art

In the automotive field it is often desirable to join two pieces of sheet metal together in a hemming operation to form a door, hood, trunk deck, or other such component. Generally, a unitary outer skin of sheet metal is hemmed to a second inner reinforcing panel of sheet metal. Hemming involves bending and compressing a generally upturned or perpendicular flange located along each edge of the outer sheet over an adjacent edge of the inner panel. It is important that the hemming results in a firm, vise-like grip of the flanges of the inner panel between the outer panel and its marginal flanges and that the shape and dimensions of the overall assembly are held within prescribed tolerances.

In the prior art, such hemming has often been accomplished in two separate stages often using two sets of dies mounted in two successive presses. The inner reinforcing panel is nested within the unitary outer panel which is fixtured on an anvil die on a base of a prehemming machine. Upon fixturing the assembly, a tool of the machine, commonly referred to as a hem or hemming blade (also referred to herein as a hem or hemming tool or die), engages and bends an edge of the outer panel to an acute included angle with respect to the outer panel. Prehemming is sometimes referred to as "fortyfive-ing" because the angle of the flange becomes about forty-five degrees with respect to the general plane of the outer panel. After prehemming all edges to be joined, both panels are released, transferred to, and fixtured in a second hemming machine where a second hemming blade completely bends the prehemmed edge of the outer panel over the peripheral edge of the reinforcing panel to secure and attach the panels together as a unitary structural member for assembly on a vehicle. This second stage is often referred to as full-hemming.

An obvious disadvantage of the two-stage, two-machine system is the need for two machines which require a significant amount of floor space as well as time and labor resources required for moving the assembly out of one press and into the second press. Because of these disadvantages, the two-stage, two-press system was improved upon and eventually evolved into a single station, two press system where prehemming and full-hemming occur without the need for re-fixturing the assembly between stages. Typically, a plurality of both prehemming and final hemming machines were respectively grouped around the periphery of a panel to perform all prehemming and full-hemming operations for one assembly either sequentially or substantially simultaneously.

After further improvements, hemming machines were designed to perform both the prehem and final hem operation in a single station, single machine system. Hemming machines of this type vary in the kind of mechanism used and the manner of carrying out the hemming operations.

One group includes machines having linkage driven hemming blades, machines having one rotary hemming blade driven by another linear driven hemming blade, and machines having one hemming blade telescopingly hem from within the prehemming hemming blade. Representative of this group are the following patents: U.S. Pat. No. 1,693,643 to D'Ardenne, U.S. Pat. No. 5,404,742 to Wilson et al, and U.S. Pat. No. 3,903,934 to Vizy.

Another group includes machines having hemming blades that traverse generally linearly in one or two directions. Hemming machines of this type, such as U.S. Pat. No. 3,143,095 to Tribe, may have a prehemming hemming blade traversing across the general plane of the outer skin and a fullhemming hemming blade traveling perpendicular to the plane of the outer skin. The obvious disadvantage of this type of machine is that it requires two hemming blades or dies, two directions of travel, extra cycle time for two operations, and a substantial amount of space around the assembly which prevents the hemming of internal edges. Alternatively, machines, such as U.S. Pat. No. 5,315,855 to Jackson, use a single hemming blade traversing in only the plane of the outer skin have been disclosed but still require a substantial amount of space preventing internal hemming and often result in a hem that is not firm, out of tolerance, and of low visual quality. Finally, there are machines, such as U.S. Pat. No. 1,961,582 to Eksergian, that travel only perpendicular to the general plane of the outer skin but still require substantial space around the assembly, two hemming blades, and do not create a quality hem.

Therefore, it is desirable to provide an improved apparatus and method for hemming sheet material together. The present invention contemplates such an invention that overcomes many of the problems of the prior art and others.

BRIEF SUMMARY OF THE INVENTION

In accordance with the present invention, an improved apparatus and method for prehemming and hemming is provided for minimizing the above-referenced and other disadvantages of the prior art, and in particular, for folding an edge portion of a curved arcuate panel to create a hem in a single cycle of operation with a single hemming swing hemming blade pressed only in the vertical direction.

In accordance with one aspect of the present invention, a hemming apparatus for hemming an outer skin and inner panel together is provided. The apparatus includes an anvil for supporting an associated assembly. The assembly comprising the outer skin and the inner panel. The apparatus additionally includes an upper body and a hemming blade mounted to the upper body. The hemming blade is adapted for movement between first and second operative positions. Furthermore, the hemming blade has a first angled surface for prehemming the assembly when the hemming blade is in the first operative position and a second angled surface for full-hemming the assembly when the hemming blade is in the second operative position.

In accordance with another aspect of the present invention, a method for hemming an outer skin and inner panel together is provided. It includes placing an assembly on a supporting surface of an anvil. The assembly comprising an inner panel positioned on an outer skin where the inner panel has a peripheral edge and the outer skin has a peripheral flange. It next includes moving a hemming blade, while in a first operative position, in a first direction into the peripheral flange of the outer skin so that an angled prehemming surface of the hemming blade deforms the flange toward the inner panel thereby prehemming the assembly. The hemming blade is further moved in the first direction moving the hemming blade into a second operative position. Meanwhile, the hemming blade moves into the deformed peripheral flange so that a hemming surface of the hemming blade engages the deformed flange and moves it into close contact with the inner panel thereby full-hemming the assembly. Finally, the hemming blade is moved away from the hemmed assembly and removing the finished assembly from the supporting surface.

One advantage of the present invention is the provision of a hemming apparatus that requires only one hemming blade reducing the construction costs of the machine and the maintenance costs of the hemming blade.

Another advantage of the present invention is the provision of a hemming apparatus that substantially reduces the risk of the die "smashing" because the machine will only use one hemming blade to contact the peripheral edge of the assembly.

Another advantage of the present invention is the provision of a hemming apparatus that lacks many complex and moving components.

Another advantage of the present invention is the provision of a hemming apparatus that uses only vertical press motion which prevents compression of the outer, and more visual, skin. Preventing such compression eliminates or reduces unsightly buckling or waves caused by overruns on the inner skin.

Another advantage of the present invention is the provision of a hemming apparatus that only requires a vertical, mechanical press for operation.

Another advantage of the present invention is the provision of a hemming apparatus that requires only one stroke of a mechanical press to produce a complete hem.

Another advantage of the present invention is the provision of a hemming apparatus that may be used in places such as window openings, gas cap openings, and the like.

Another advantage of the present invention is the provision of a hemming apparatus that substantially reduces the number of weld spots typically required for an entire assembly.

Still further advantages and benefits of the present invention will become apparent to those of ordinary skill in the art upon reading and understanding the following detailed description.

BRIEF DESCRIPTION OF THE DRAWINGS

The structure, operation and advantages of the presently preferred embodiment of this invention will become further apparent upon consideration of the following description, taken in conjunction with the accompanying drawings. Of course, the drawings are only for purposes of illustrating preferred embodiments and are not to be construed as limiting the invention.

DETAILED DESCRIPTION OF THE INVENTION

Figure 1A:
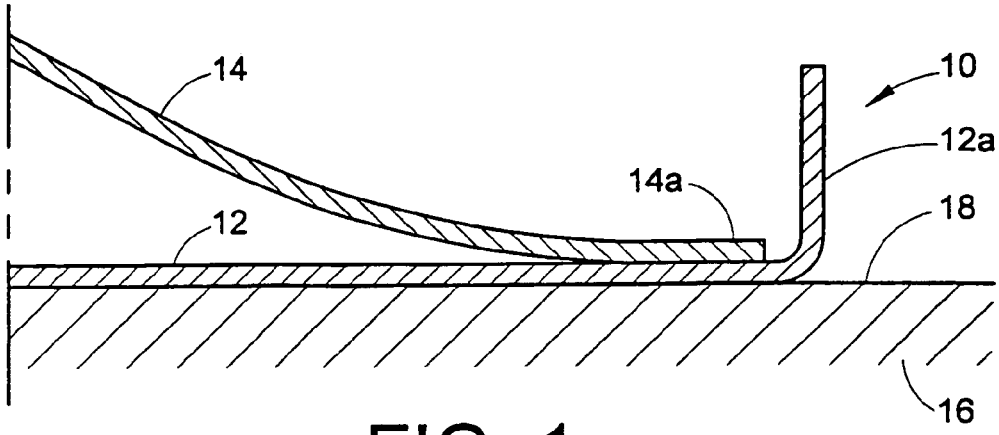
FIG. 1*a* is a cross-sectional view of two sheets prior to prehemming and full-hemming in accordance with aspects of the present invention.

Referring now to the drawings wherein like reference characters represent like elements, the showings are for purposes of illustrating preferred embodiments of the invention only and not for purposes of limiting the same. The improved hemming apparatus and method described in the description below accurately and speedily carries out an entire prehemming and clinching/full-hemming operation in one cycle and supplies firmly clinched flanges without affecting the dimensional accuracy or the visual appearance of the finished product.

Figure 1B:
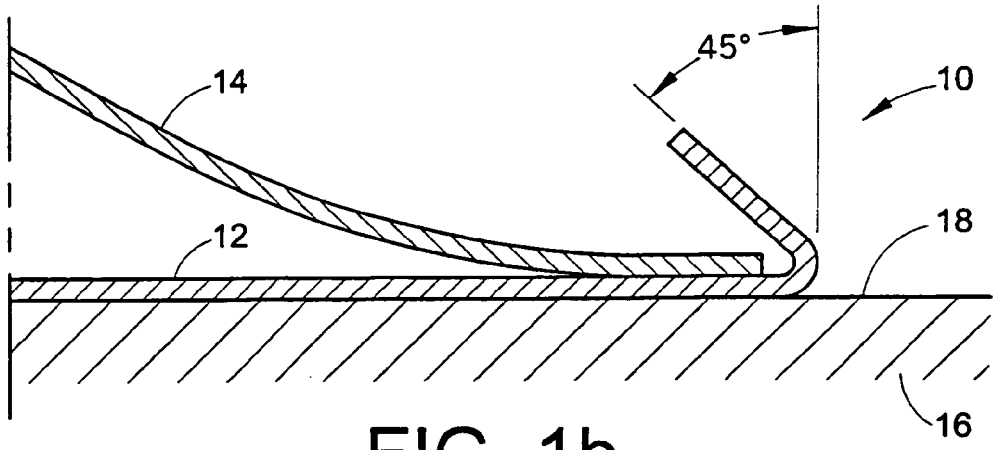
FIG. 1*b* is a cross-sectional view of the two sheets depicted in FIG. 1*a* after prehemming and before full-hemming in accordance with aspects of the present invention.
Figure 1C:
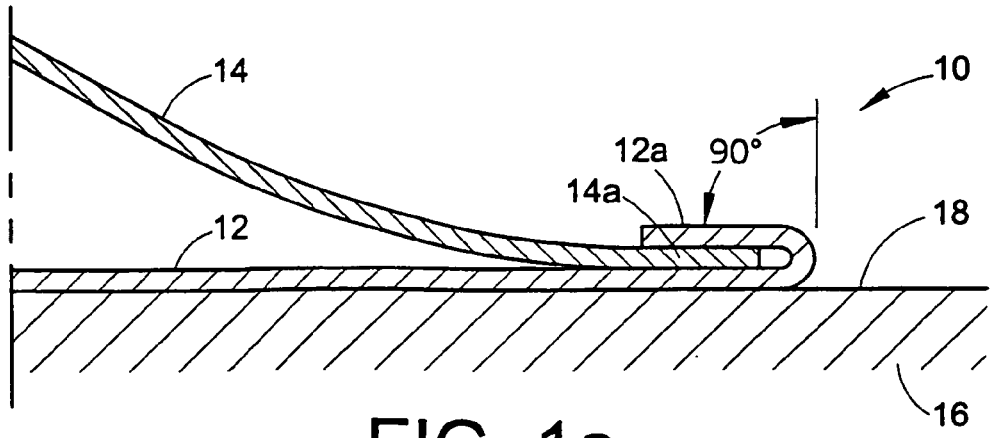
FIG. 1*c* is a cross-sectional view of the two sheets depicted in FIG. 1*a* after prehemming and full-hemming in accordance with aspects of the present invention.

With reference to FIGS. 1*a*–1*c*, an assembly is generally indicated by reference numeral 10. The assembly 10 includes two elements of pressed sheet metal or other suitable material respectively constituting the unitary outer skin 12 and the inner reinforcing panel 14 of a motor vehicle assembly. The assembly 10 may be, without limitation, a motor vehicle door, hood, trunk deck or other component. The assembly 10 rests on a fixed supporting structure or anvil 16. The anvil 16 has a horizontal supporting surface 18 for positioning and supporting the outer skin 12 and the inner panel 14.

FIGS. 1*a*–1*c* depict the sequential movement and resulting position of the assembly 10 during a hemming operation. With specific reference to FIG. 1*a*, the outer skin 12 and the inner panel 14 are shown at rest prior to the hemming operation. The underlying outer skin 12 has a peripheral flange 12*a* arranged substantially at ninety degrees with respect to the anvil supporting surface 18 and is offset slightly from distal end of the peripheral edge 14*a* of the overlying inner panel 14 as is well known.

With specific reference to FIG. 1*b*, the outer skin 12 and the inner panel 14 are shown after the first step or prehemming step of the hemming operation. In this step, the peripheral flange 12*a* of the outer skin 12 is bent forty-five degrees relative to its starting position in the direction of the inner panel 14.

With specific reference to FIG. 1*c*, the outer skin 12 and the inner panel 14 are shown after the clinching or full-hemming step. In this step, the peripheral flange 12*a* of the outer skin 12 is bent further and now is arranged at about ninety degrees relative to its initial position. The peripheral flange 12*a* is superimposed and pressed against the peripheral edge 14*a* creating a joint between the outer skin 12 and the inner panel 14. Many such joints may exist on a single assembly 10 and are generally located about the periphery edges of the outer skin 12 and the inner panel 14. Joints may even be located at interior locations on the assembly 10 such as a window or gas cap recess.

Figure 2:
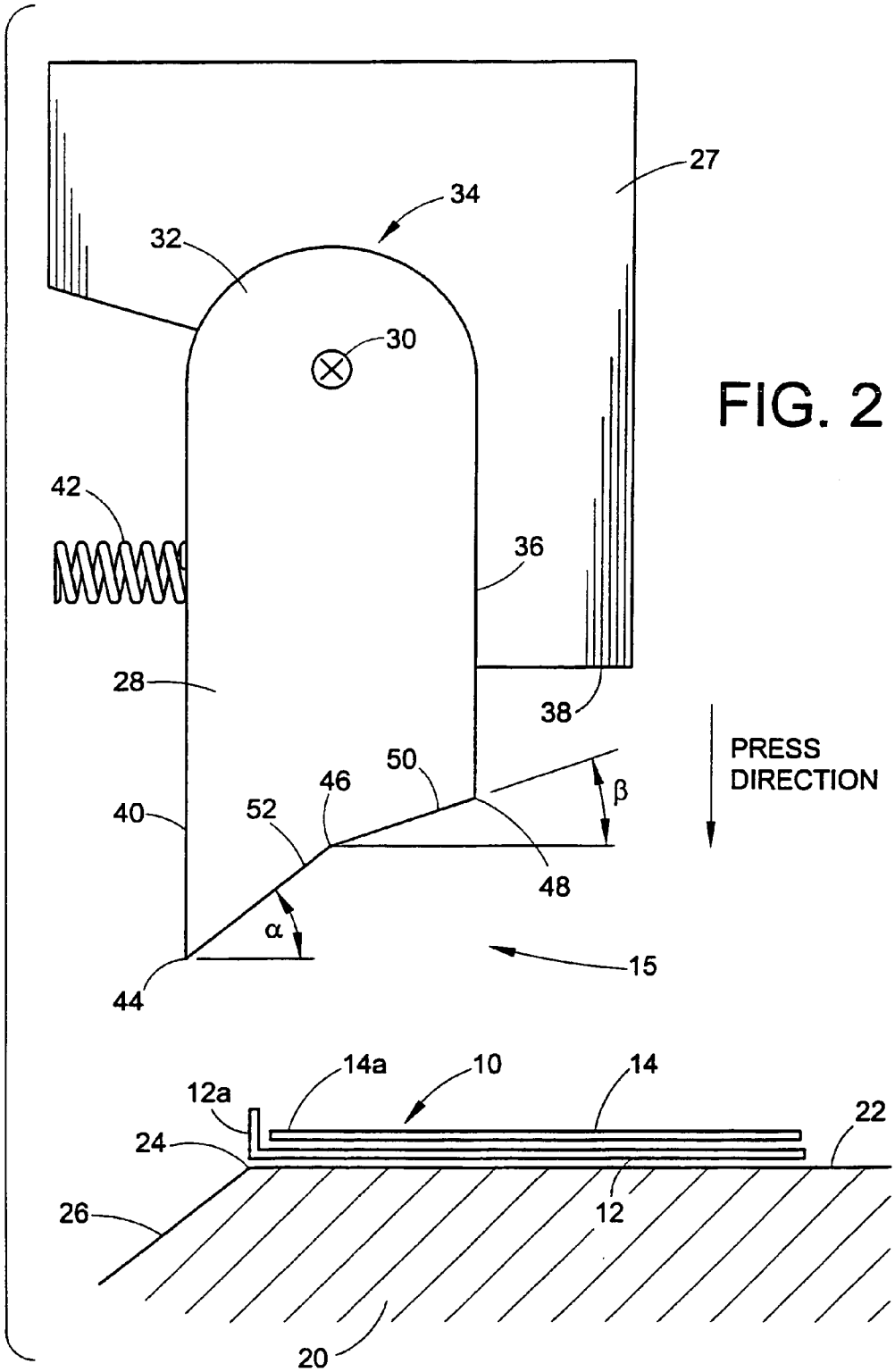
FIG. 2 is a diagrammatic view showing a preferred embodiment of a hemming apparatus in accordance with aspects of the present invention.

With reference to FIG. 2, a hemming apparatus 15 includes a lower body or anvil 20 having a major supporting surface 22 for supporting the unitary outer skin 12 and the inner reinforcing panel 14. The inner panel 14 is positioned on the outer skin 12 with its edge 14*a* slightly offset from the peripheral flange 12*a*. The flange 12*a* is arranged substantially at ninety degrees with respect to the anvil supporting surface 22. The peripheral flange 12*a* on the outer skin 12 rests directly along one edge 24 of the anvil 20. The same edge 24 of the anvil 20 is adjacent to a sloping side 26, angled at forty-five degrees in the preferred embodiment of the invention.

The hemming apparatus 15 additionally includes an upper body 27 as either a connected or separate component. The upper body 27 is mounted to a vertical press (not shown) as is well known. The upper body 27 holds the swing tool or hemming blade 28 formed in accordance with the present invention by means of a screw 30 or the like. Hemming blade 28 is constructed of a suitable material with an appropriate hardness as is well known. The hemming blade 28 has a round or rounded upper surface 32 which nestles inside a curved recess 34 of the upper body 27 such that the hemming blade 28 may pivot outward from the upper body 27. An inner side 36 of the hemming blade 28 rests against the keeper or extended portion 38 of the upper body 27. The outer or exposed side 40 is open and held in place by a spring 42 or other biasing means. The spring 42 is a blue medium duty die spring with a strength of 216 lbs. in the preferred embodiment. Of course, other suitable springs may be used.

The bottom surface of the hemming blade 26 has two angled surfaces 50 and 52 defined at angles $\alpha$ and $\beta$, respectively. Angles $\alpha$ and $\beta$ are relative to respective planes positioned parallel to the supporting surface 22. The prehemming angled surface 52, extends from the bottom open edge 44 of the hemming blade 28 inward and upward to the approximate center 46 of the hemming blade 28 at an angle $\alpha$ which is equal to that of the sloped side 26 of the anvil 20. Full-hemming angled surface 50 extends from the closed, bottom edge 48 of the hemming blade 28 inward and downward at angle $\beta$ to the approximate center 46 of the hemming blade 28 meeting prehemming angled surface 52. The magnitude of angle $\beta$ is such that when the hemming blade 28 is forced vertically downward to its farthest position at which point the hemming blade 28 is pivoting against the spring 42, angled surface 50 will rest parallel to the supporting surface 22 of the anvil 20.

In operation, the upper body 27 moves the hemming blade 28 downward in a first operative position to contact the peripheral flange 12*a* of the outer skin 12 and the sloping side 26 of the anvil 20. The upper body 27 is powered by a vertical press as is well known but other suitable driving means may be employed. When the hemming blade 28 first contacts the peripheral flange 12*a*, the flange 12*a* will bend inward toward the inner panel 14 until the prehemming angled surface 52 of the hemming blade 28 contacts the sloping side 26 of the anvil 20. At this point, the hemming blade is still in the first operative position and the bend in the peripheral flange 12*a* is at angle $\alpha$ relative to the supporting surface 22 of the anvil 20. Thus, the prehemming of the peripheral flange 12*a* to the inner panel 14 is complete.

As the upper body 27 continues to move the hemming blade 28 downward, i.e., toward the anvil support surface 22 and a second operative position, the hemming blade 28 is forced to pivot from the upper body 27 at the screw 30 against the force of the spring 42 owing to the prehemming surface 52 of the hemming blade 28 slidably engaging the sloping side 26 of the anvil 20. The stiffness of the spring 42 is such that hemming blade 28 is generally secured against upper body 27, including during the prehemming operation, but gives appropriately when the hemming blade 28 is forced to pivot against sloping side 26 of the anvil 20. The hemming blade 28 will continue pivoting and moving downward until the full-hemming angled surface 50 is substantially parallel to the supporting surface 22 of the anvil 20. At this point, the hemming blade is in the second operative position and the peripheral flange 12*a* of the outer panel 12 and the inner panel 14 are completely hemmed.

In a preferred embodiment, the peripheral flange 12*a* will be arranged at about ninety degrees with respect to its initial position so that it is superimposed and pressed against the peripheral edge 14*a*. The upper body 27 is then retracted upwards, moving the hemming blade 28 upward and away from the hemmed outer skin 12 and inner panel 14. Of course, the spring 42 or other biasing means moves the hemming blade 28 to its home or first operative position illustrated in FIG. 2. The outer skin 12 and inner panel 14 together form a complete hemmed assembly 10 which may now be removed from the anvil 20. Thus, the apparatus 15 will have only used one cycle of a vertical press to complete both the prehemming and full-hemming operations. Several hemming blades 28 may be employed simultaneously and powered by a single vertical press. In such an arrangement, several hems are completed upon one stroke of the vertical press.

Figure 3:
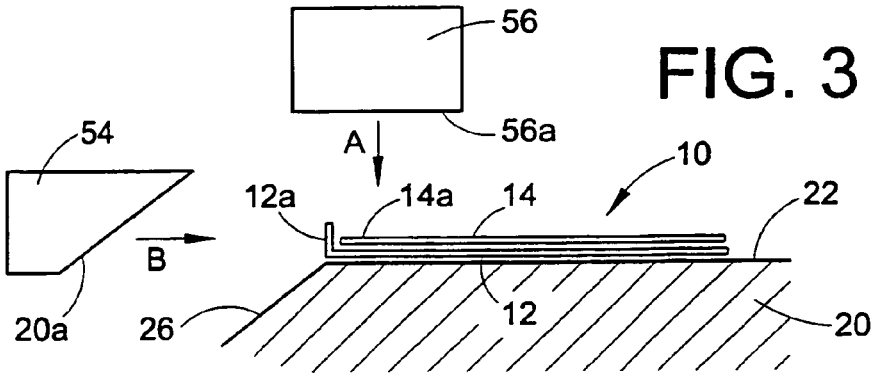
FIG. 3 is a diagrammatic side view of a prior art two surface, two-directional hemming apparatus and its related compression forces.

An important aspect of the present invention relates to its ability to substantially reduce undesirable compression forces typically exerted on the peripheral flange 12*a* in prior art hemming machines. Referring to FIG. 3, previously known devices often use a two hemming blade, two-stage process or other similar process to hem the outer skin 12 to the inner panel 14. Prehemming is accomplished when a horizontal hemming blade 54 moves toward the assembly 10 and engages the peripheral flange 12*a*. Horizontal hemming blade 54 continues and forces peripheral flange 12*a* to bend inward toward supporting surface 22 of the anvil 20 until horizontal hemming blade surface 54*a* meets sloping surface 26.

Such a prehemming process is problematic because horizontal hemming blade 54 begins forcing peripheral flange 12*a* to bend against the peripheral edge 14*a*. Thus, the skin 12 exerts a force on the panel 14 during the bending. Between the force of horizontal hemming blade 54 and the immobile resistance of anvil 20, this force causes either the outer skin 12 or the inner panel 14 to buckle producing an undesirable and rough finish. The vertical hemming blade 56 completes the hem by full-hemming the peripheral flange 12*a* to the peripheral edge 14*a* but the unsightly buckle remains in the outer skin 12 or the inner panel 14.

Figure 4:
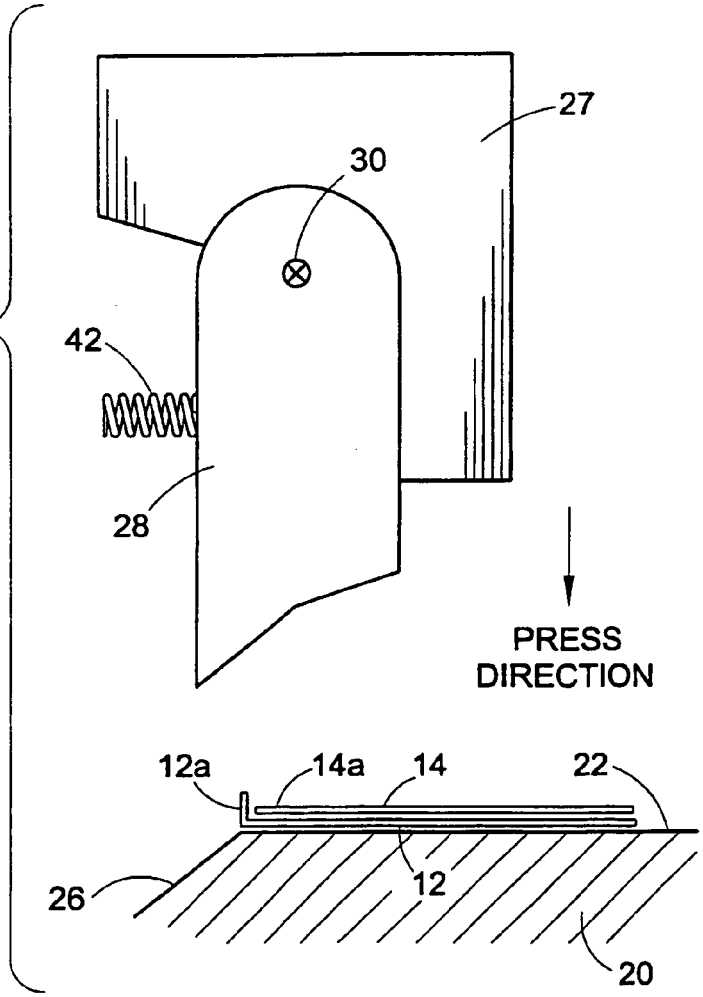
FIG. 4 is a diagrammatic view of the hemming apparatus shown in FIG. 2 and its related compression forces in accordance with aspects of the present invention.

Referring to FIG. 4, the present invention uses only vertical motion to complete the hemming operation in contrast to the prior art. The upper body 27 moves the hemming blade 28 downward toward the peripheral flange 12*a*. When the tool 28 engages the peripheral flange 12*a* and begins bending the peripheral flange 12*a* inward and downward toward the supporting surface 22 of the anvil 20, the force C applied to the peripheral flange 12*a* is substantially downward. The buckling problem of the prior art is absent because the peripheral flange 12*a* is allowed to move out toward the slope side 26 of the anvil 20. Thus, the finished hem has a desirable finish without any unsightly buckles.

Optionally, an adhesive may be applied to the peripheral flange 12*a* of the outer skin 12 and to the peripheral edge 14*a* of the inner panel 14 prior to hemming to enhance the integrity of the hem. The adhesive seals and firms the hem and enhances some or all of the advantages of the present invention.

Figure 5:
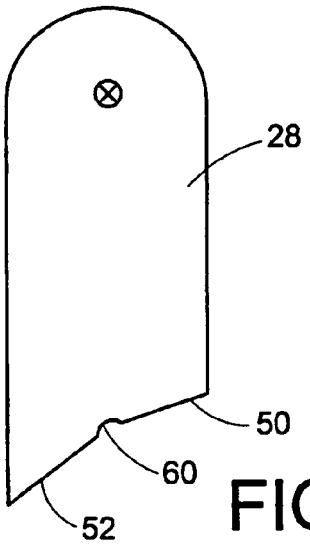
FIG. 5 is a diagrammatic view of an alternate embodiment of a hemming blade in accordance with aspects of the present invention.

Alternately, with additional reference to FIG. 5, the hemming blade 28 may include an indented radius 60 located along the intersecting edge between the full-hemming angled surface 50 and prehemming angled surface 52. The radius 60 provides clearance between the hemming blade 28 and the assembly 10 during the movement of the hemming blade 28 from the first operative position where prehemming occurs and the second operative position where full-hemming occurs. Such clearance decreases the likelihood of the hemming blade 28 damaging the peripheral flange 12*a* and edge 14*a* during the transition between the two positions.

Figure 6A:
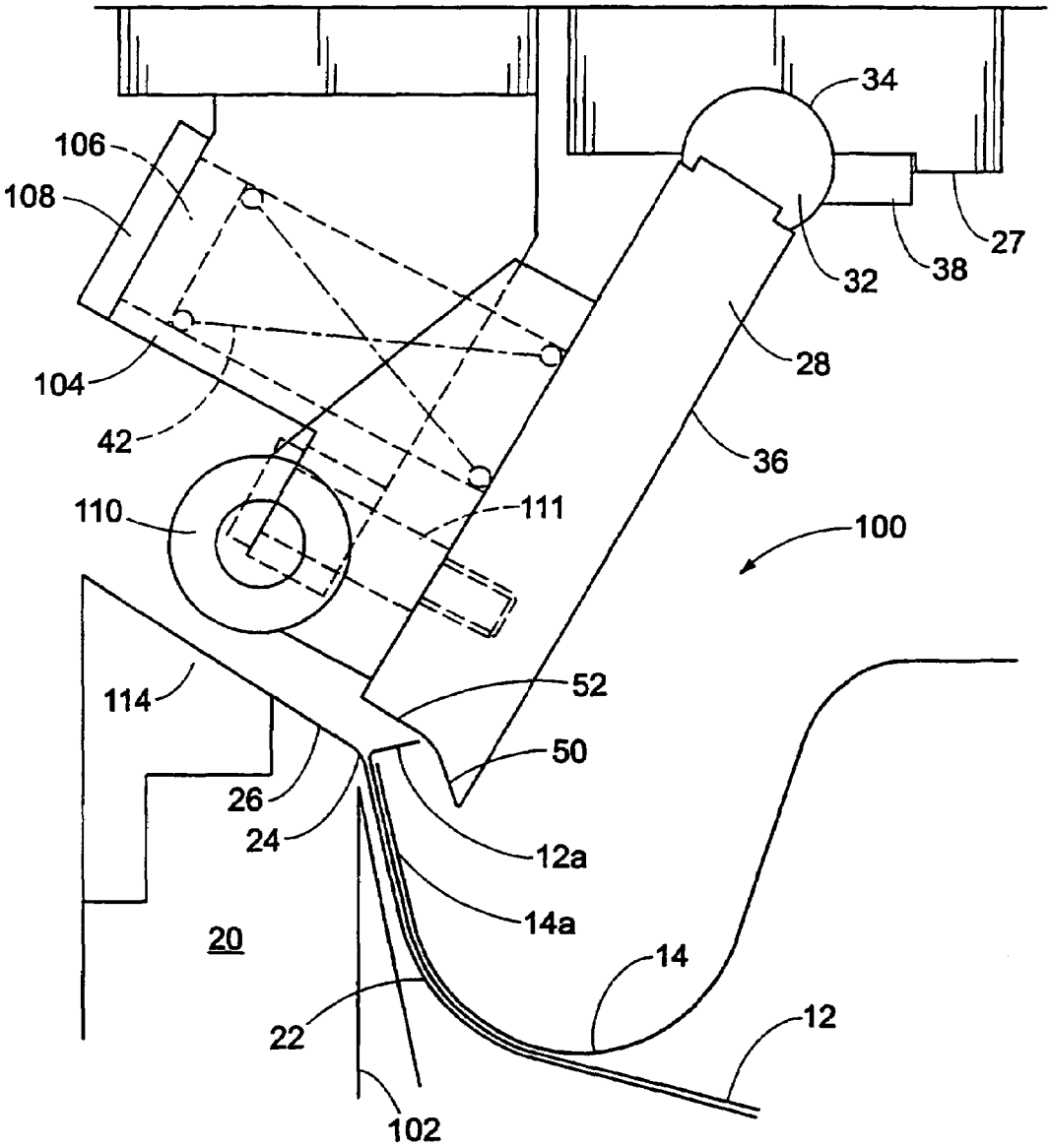
FIG. 6*a* is a diagrammatic view showing an alternate preferred embodiment of a hemming apparatus in accordance with aspects of the present invention.
Figure 6B:
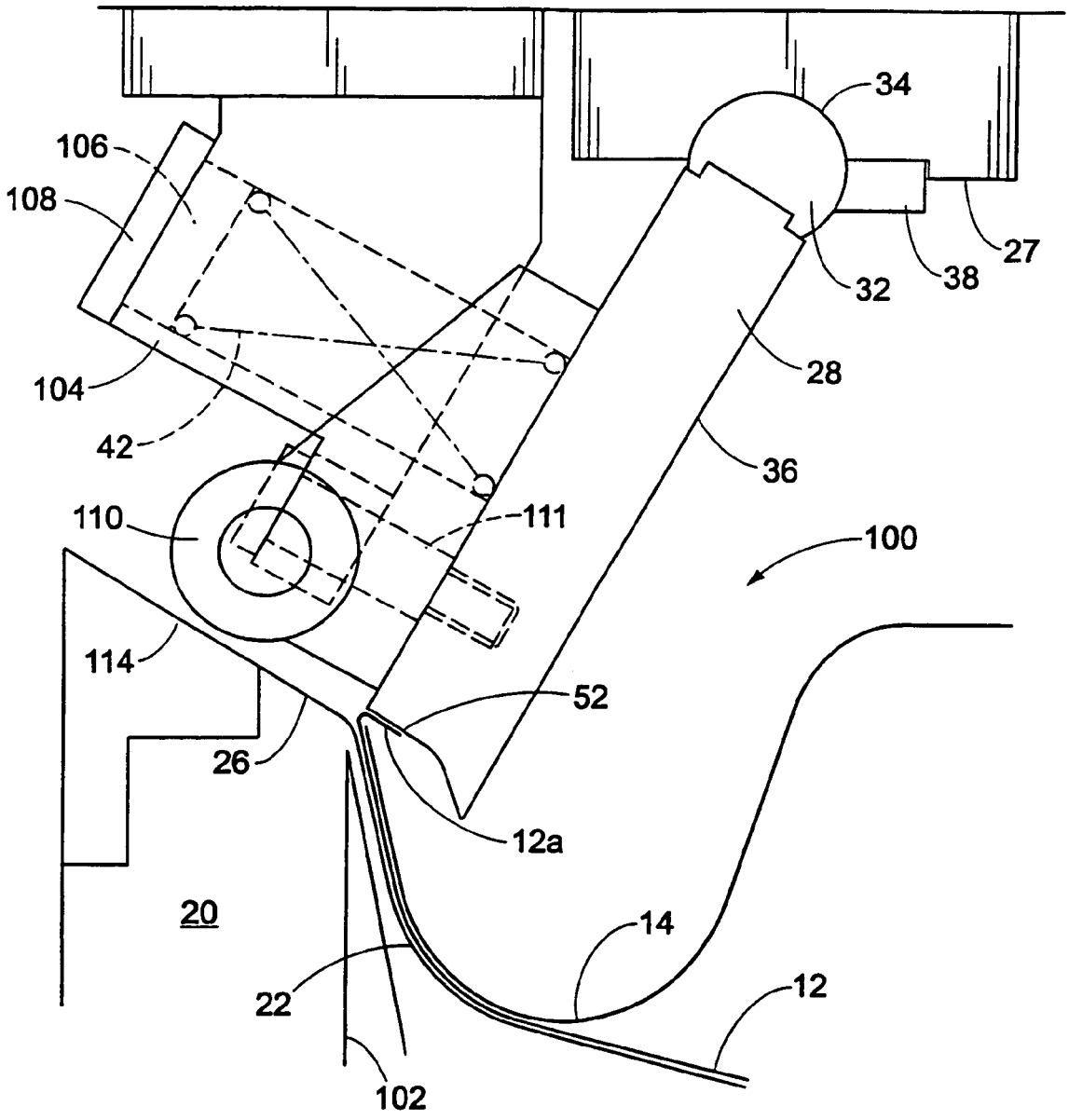
FIG. 6*b* is a diagrammatic view of the hemming apparatus shown in FIG. 6*a* showing the hemming blade in a first position prehemming an assembly.
Figure 6C:
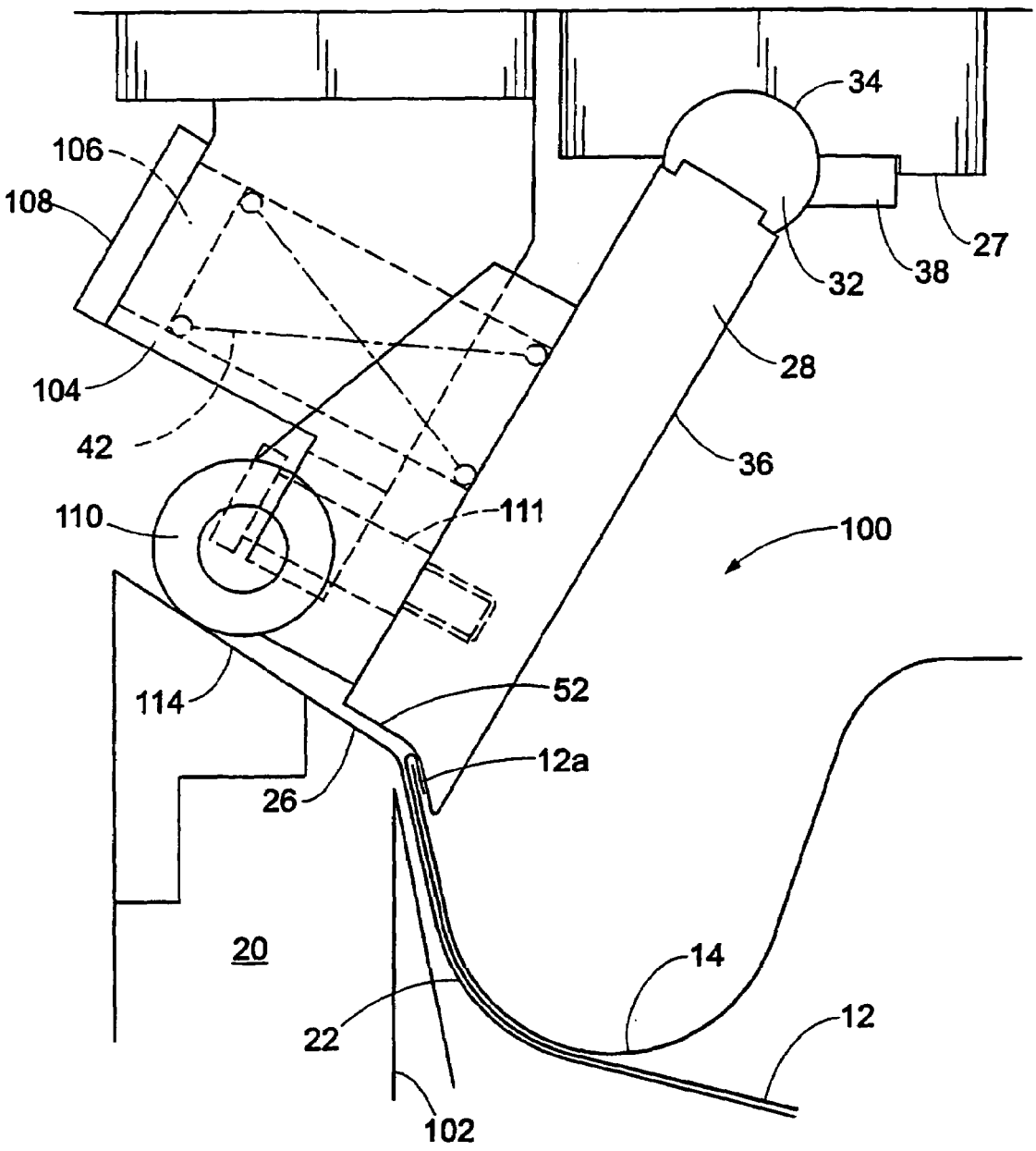
FIG. 6*c* is a diagrammatic view of the hemming apparatus shown in FIG. 6*a* showing the hemming blade in a second position full-hemming the assembly.

With reference to FIGS. 6*a*–6*c*, a hemming apparatus 100 is shown according to an alternate preferred embodiment of the present invention. The apparatus 100 includes an anvil 20 having a major supporting surface 22 for supporting the unitary outer skin 12 and the inner reinforcing panel 14. The supporting surface 22 is angled approximately twelve degrees relative to the vertical face 102 of the anvil 20. The outer skin 12 rests on the supporting surface 22 with the inner panel 14 positioned on the outer skin 12. The outer skin 12 includes a peripheral flange 12*a* which extends away from and perpendicular to the supporting surface 22. The peripheral flange 12*a* is positioned at or near one edge 24 of the anvil 20. Adjacent the supporting surface 22 is a sloping side 26 which extends at a forty-five degree angle relative to the supporting surface 22.

The hemming apparatus 100 includes an upper body 27. The upper body 27 is mounted to vertical press by means of a die shoe and a machine hemming blade sub plate as is well known. The upper body 27 holds a hemming blade 28 formed in accordance with the present invention. The hemming blade 28 has a rounded upper surface 32 which nestles inside a curved recess 34 of the upper body 27. An inner side 36 of the hemming blade 28 rests against an extended portion 38 of the upper body 27.

The apparatus 100 additionally includes a spring housing 104 that encloses a medium or heavy duty die spring 42. The housing 104 is adapted to receive a preload spacer 106 at a distal end of the spring 42 and includes a spring cap 108 for forcing the spring 42 against the hemming blade 28. The preload spacer 106 may vary and serves the purpose of allowing for variable adjustment of the resistance of the spring 42. A plurality of roller bearings 110 are also provided and secured to the hemming blade 28 by a connecting means 111. Roller bearings 110 engage a cam 114 mounted to the anvil 20 upon actuation and movement of the vertical press toward the anvil 20 so that roller bearings 110 travel on the cam 114 and move the hemming blade 28 into its second operative position. The hemming blade 28 is shown in a first position prior to actuation and movement by the vertical press.

Similar to the first preferred embodiment, the hemming blade 28 has two angled surfaces, a prehemming surface 52 and a full-hemming surface 50. The respective angles of the surfaces 50 and 52 are calculated as described above. The prehemming surface 52 is at an angle approximately equal to that of the sloping side 26 and the hemming surface 50 is at an angle adapted to provide a full hem upon pivotal movement of the hemming blade 28.

In operation, the upper body 27, powered by the vertical press, moves the hemming blade 28 toward the peripheral flange 12*a* of the outer skin 12. The hemming blade 28 is initially in a first or resting position, i.e., the hemming blade 28 is urged against the extended portion 38 by the spring 42. The hemming blade 28 will contact and bend the peripheral flange 12*a* inward toward the inner panel 14 until the roller bearings 110 engage the cam 114. With reference to FIG. 6*b*, the bend in the peripheral flange 12*a* is at an angle approximately equal to the sloping side 26 of the anvil 20 and the roller bearings 110 are fully engaged with the cam 114. Thus, the prehemming of the peripheral flange 12*a* is complete. At this point, the engagement between the roller bearings 110 and the cam 114 prevent the prehemming surface 52 of the hemming blade 28 from moving any further into the peripheral flange.

Further movement by the vertical press forces the hemming blade 28 to pivot against the spring 42. The roller bearings 110 move along the cam 114 and the hemming blade 28 pivots from a first position to a second position. During the transition from the first position to the second position, the full-hemming surface 50 of the hemming blade 28 engages and moves the peripheral flange 12*a* of the outer skin 12. The full-hemming surface 50 continues to bend the peripheral flange 12*a* toward the inner panel 14 until the flange 12*a* is superimposed and pressed against the peripheral edge 14*a* of the inner panel 14. At this point the hemming blade 28 is in its second operative position and the assembly is fully hemmed (FIG. 6*c*). As in a previous embodiment, the vertical press may be reversed to remove the hemming blade 28 from the hemmed assembly 10 and the hemmed assembly 10 may be removed.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A hemming apparatus for hemming an outer skin and inner panel together, the apparatus comprising:

an anvil for supporting an associated assembly comprising an outer skin and an inner panel, the anvil has a supporting surface and a sloped side;

an upper body; and a hem blade mounted to the upper body and pivotally movable between first and second operative positions, the hem blade having a first angled surface that prehems the associated assembly when the hem blade is in the first operative position and a second angled surface that full-hems the associated assembly when the hem blade is in the second operative position, the sloped side of the anvil contacts and moves the hem blade from the first operative position to the second operative position.

2. The apparatus of claim 1 wherein the first angled surface of the hem blade is defined at substantially the same angle as the sloped side of the anvil.

3. The apparatus of claim 2 wherein the second angled surface of the hem blade lies parallel to the supporting surface of the anvil when the hem blade is in the second operative position.

4. The apparatus of claim 1 further comprising:

a cam surface defined by the anvil; and a cam roller operatively secured to the hem blade, the cam roller engaging the cam surface and moving the hem blade from the first operative position to the second operative position when the hem blade is moved adjacent the anvil.

5. The apparatus of claim 1 further comprising:

a bias means for urging the hem blade toward the first operative position.

6. The apparatus of claim 5 wherein the bias means is a spring.

7. The apparatus of claim 1 wherein the hem blade includes an indented radius along an intersecting edge of the first and second angled surfaces, the radius appropriately sized to provide clearance between the hem blade and the assembly when the hem blade transitions from the first to the second operative position.

8. The apparatus of claim 1 wherein the hem blade is connected to the upper body without any links.

9. A hemming apparatus for hemming panels together, the apparatus comprising:

an anvil including a sloped surface and a support surface adapted for supporting an assembly that includes first and second adjacent panels to be hemmed, the first panel including a peripheral flange projecting away from the anvil support surface and the second panel including a peripheral edge adjacent the flange;

an upper body, at least one of said anvil and said upper body movable toward the other;

a hemming blade pivotally connected to the upper body and adapted for movement between first and second operative positions, the hemming blade defining a prehemming surface and a hemming surface angled at respective first and second angles relative to the anvil support surface whereby, upon movement of the upper body and the anvil together, the prehemming surface contacts and deforms the flange, and upon continued movement of the upper body and anvil together the hemming blade pivotally moves about a single pivot point on the upper body to the second operative position so that the second, full-hemming surface engages the deformed flange and moves the deformed flange into close abutment with the second panel, the hemming blade being forced to pivot from the first position to the second position as the hemming blade engages the sloped surface of the anvil.

10. The apparatus of claim 9 further comprising:

a bias means for urging the hemming blade to the first operative position.

11. The apparatus of claim 10 wherein the bias means is a spring.

12. The apparatus of claim 9 wherein the anvil includes a sloped surface adjacent the support surface that contacts and moves the hemming blade from the first operative position to the second operative position when the anvil and the upper body move together.

13. The apparatus of claim 9 wherein the hemming blade is only pivotally connected to the upper body and adapted to pivot between the first and second operative positions.

14. The apparatus of claim 9 wherein an adhesive is between the peripheral flange and the peripheral edge after the flange is in close abutment with the second panel.

15. A method for hemming an outer skin and inner panel together, the method comprising the steps of:

placing an assembly on a supporting surface of an anvil having a sloped surface, the assembly comprising an inner panel positioned on an outer skin, the inner panel having a peripheral edge and the outer skin having a peripheral flange;

moving a hemming blade, while in a first operative position, in a first direction into the peripheral flange of the outer skin so that an angled prehemming surface of the hemming blade deforms the flange toward the inner panel thereby prehemming the assembly;

moving the hemming blade further in the first direction and simultaneously pivotally moving the hemming blade to the second operative position by the sloped surface engaging the hemming blade and causing the hemming blade to move from the first operative position to the second operative position when the hemming blade is moved in the first direction after prehemming so that a hemming surface distinct from said prehemming surface of the hemming blade engages the deformed flange and moves said flange into close contact with the inner panel thereby full-hemming the assembly;

moving the hemming blade away from the hemmed assembly; and removing the finished assembly from the supporting surface.

16. The method of claim 15 wherein the peripheral flange of the outer panel is upstanding and the peripheral edge of the inner panel is flat, both relative to the supporting surface and prior to any contact by the hemming blade.

17. The method of claim 15 further comprising:

applying an adhesive to at least one of the inner panel and the outer skin in the region of the peripheral edge and the peripheral flange, respectively.

18. The method of claim 15 wherein the prehemming occurs substantially simultaneously with the hemming blade moving toward and engaging the sloped side of the anvil.

19. The method of claim 15 wherein movement of the hemming blade from the first operative position to a second operative position is completed during a single stroke of the hemming blade in the first direction.

20. The method of claim 19 wherein the single stroke is continuous and uninterrupted.

21. A hemming method comprising:

providing a first sheet metal panel including a first surface and an upturned flange that projects outwardly away from the first surface;

placing a second surface of a second sheet metal panel in abutment with the first surface, with an edge of the second sheet metal panel adjacent the upturned flange, the first and second sheet metal panels together defining a sheet metal assembly;

supporting the assembly on a support surface;

providing a hemming tool with a prehemming surface inclined at a first angle relative to the support surface and a full-hemming surface inclined at a second angle relative the support surface, the prehemming surface and the full-hemming surface together forming a concave work surface wherein the angle between the prehemming surface and the full-hemming surface is less than 180 degrees when measured on the side of the working surface;

moving the hemming tool in a first direction to a prehemming location so that the prehemming surface of the tool contacts and deforms the flange toward the first and second sheet metal panels;

moving the hemming tool angularly relative to the support surface so that the full-hemming surface of the hemming tool is operatively positioned relative to the deformed flange; and moving the hemming tool from the prehemming location further in the first direction to a full-hemming position so that the full-hemming surface of the hemming tool contacts and moves the deformed flange into close abutment and wrapping engagement with the second sheet metal panel, wherein the engagement between the hemming tool and the support surface while the hemming tool is moved further in the first direction moves the hemming tool angularly relative to the support surface.

22. The hemming method of claim 21 wherein the steps of moving the hemming tool in the first direction to the prehemming location and moving the hemming tool in the first direction to a full-hemming location are effected by a single movement of the hemming tool in the first direction.

23. The hemming method of claim 21 wherein the step of moving the hemming tool angularly results from the step of moving the hemming tool in the first direction from the prehemming location to the full-hemming location when the hemming tool contacts and engages at least one of the support surface and a fixed member adjacent the support surface.

24. A method for hemming an outer skin and inner panel of a motor vehicle assembly together, the method comprising the steps of:

placing an assembly on a supporting surface of an anvil, the assembly comprising an inner panel positioned on the an outer skin, the inner panel having a peripheral edge and the outer skin having a peripheral flange;

moving a hemming die in a single stroke into the peripheral flange of the outer skin and the peripheral edge of the inner panel thereby hemming the assembly, the hemming die having a first angled surface for effecting a prehem and a second angled surface for effecting a full-hem, wherein the hemming die pivotally moves about a single axis fixed on an upper body to which the hemming die is mounted from a first prehem position to a second full-hem position during the single stroke to align the first and second angled surfaces with the assembly sequentially, engagement between a sloped surface of the anvil and the hemming die causing the pivoted movement of the hemming die about the single axis fixed on the upper body;

removing the steel from the hemmed assembly; and removing the finished assembly from the supporting surface.

* * * * *